US010100270B1

(12) United States Patent
Moser

(10) Patent No.: US 10,100,270 B1
(45) Date of Patent: Oct. 16, 2018

(54) PROCEDURE TO ACQUIRE CLEANING AGENT

(71) Applicant: Gail R. Moser, Grande Prairie (CA)

(72) Inventor: Gail R. Moser, Grande Prairie (CA)

( * ) Notice: Subject to any disclaimer, the term of this patent is extended or adjusted under 35 U.S.C. 154(b) by 113 days.

(21) Appl. No.: 15/398,131

(22) Filed: Jan. 4, 2017

(51) Int. Cl.
*C11D 3/386* (2006.01)
*C11D 3/382* (2006.01)
*C11D 11/00* (2006.01)

(52) U.S. Cl.
CPC ..... *C11D 3/382* (2013.01); *C11D 11/00* (2013.01); *C11D 3/386* (2013.01)

(58) Field of Classification Search
CPC ..... C11D 3/386; A23L 27/88; A23L 27/11; A23L 31/00
USPC ..... 510/374; 426/655
See application file for complete search history.

(56) References Cited

U.S. PATENT DOCUMENTS

| | | | | |
|---|---|---|---|---|
| 3,817,875 | A | 6/1974 | Bazan | |
| 3,839,234 | A | 10/1974 | Roscoe | |
| 4,311,608 | A | 1/1982 | Maurice | |
| 5,075,026 | A | 12/1991 | Loth | |
| 6,384,010 | B1 | 5/2002 | Wagers | |
| 8,741,827 | B2 | 6/2014 | Vyrostko et al. | |
| 2005/0020473 | A1 | 1/2005 | Gallotti et al. | |
| 2005/0139608 | A1* | 6/2005 | Muehlhausen | B65D 81/3283 222/94 |
| 2010/0055768 | A1* | 3/2010 | Lant | C11D 3/38654 435/263 |
| 2016/0037814 | A1* | 2/2016 | Chatani | A23L 27/88 426/590 |

FOREIGN PATENT DOCUMENTS

| | | |
|---|---|---|
| CA | 2007812 | 4/1995 |
| CA | 2126269 | 9/1995 |
| CA | 2205404 | 5/1996 |
| CA | 2412820 | 8/2008 |
| CA | 2724642 | 11/2011 |
| CA | 2281327 | 6/2012 |
| CA | 2633163 | 11/2013 |
| CN | 104277936 | 1/2015 |

* cited by examiner

*Primary Examiner* — Gregory E Webb
(74) *Attorney, Agent, or Firm* — Miller & Hurley

(57) ABSTRACT

A method of making an organic cleaning agent, which includes the steps of picking a specific edible mushroom with a specific size, soaking the specific edible mushroom in water without squishing for a specific amount of time so as to form a soaked and unsquished mushroom, squishing the soaked and unsquished mushroom a specific amount so as to form a squished mushroom, and soaking the squished mushroom in boiling water for a specific amount of time so as to form a treated liquid, so that the treated liquid formed thereby is the organic cleaning agent.

45 Claims, 8 Drawing Sheets

METHOD (10) FOR MAKING THE ORGANIC CLEANING AGENT (12)
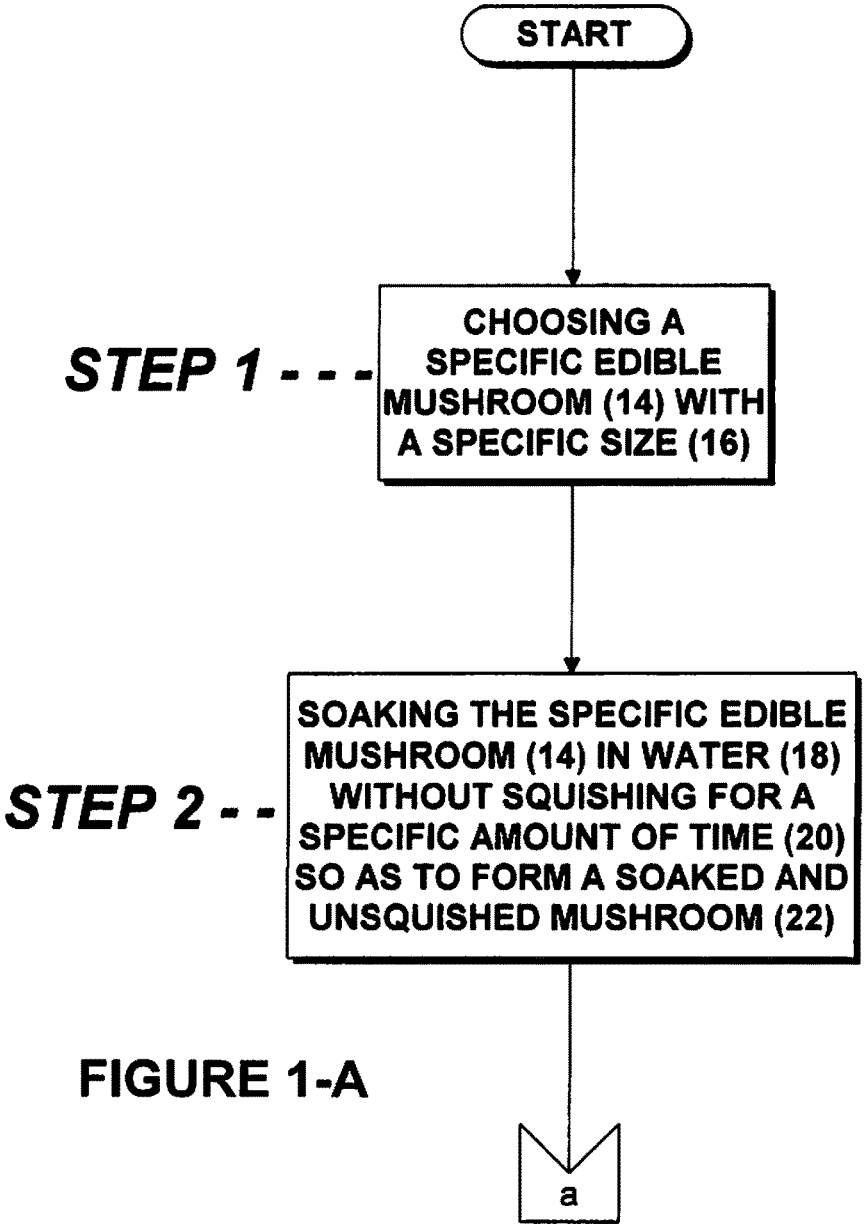
FIGURE 1-A

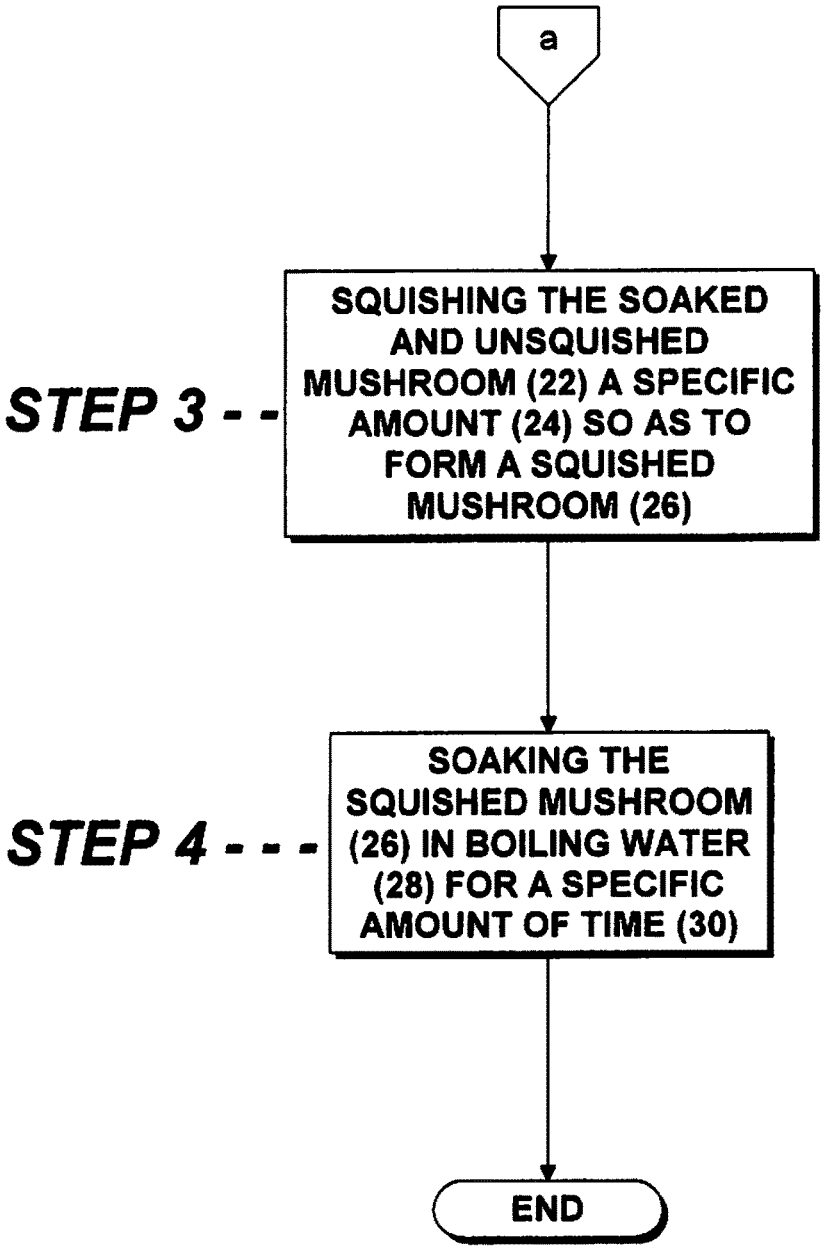
FIGURE 1-B

| | FIGURE 2 | Size | Time non-squished mushroom soaks in water before use | Amount of squishing | Time squished mushroom soaks in the boiling water before use | Rating |
|---|---|---|---|---|---|---|
| 1 | HALF FREE MOREL - Brownish smooth irregular cap. dried mushroom, hollow, one mushroom 3/8 - 1-5/8 high & wide, 3/4 - 4" stem, honeycomb look | 1 gram dried &wet | 4-6 hours 1-2 hours | plunge & hold down several times | 1-2 hours | 10 |
| 2 | BLACK MOREL, hollow, dried one mushroom 3/4 - 1-5/8 wide, 3/4 - 2" high | 1 gram dried &wet | 4-6 hours 1-2 hours | plunge & hold down several times | 1-2 hours | 10 |
| 3 | SHITAKE MUSHROOM, dried, one mushroom | 1 gram dried &wet | 4-6 hours 1-2 hours | plunge & hold down several times | 1-2 hours | 9 |
| 4 | WESTERN GIANT RIFFBALL, white, sphere, piece of mushroom, dried | 1 gram dried &wet | 4-6 hours 1-2 hours | plunge & hold down several times | 1-2 hours | 6 |
| 5 | GIANT RIFFBALL, huge, white, smooth, sphere, one piece, dried | 1 gram dried &wet | 4-6 hours 1-2 hours | plunge & hold down several times | 1-2 hours | 6 |
| 6 | GIANT CLITOCYBE, funnelled, smooth, a piece, dried, 4 - 18" wide, 1/4" stalk, whitish | 1 gram dried &wet | 4-6 hours 1-2 hours | plunge & hold down several times | 1-2 hours | 10 |
| 7 | WILLOW MILKY, large cap, pinkish gills, V-shaped, dried one piece, 1-5/8 - 9" wide, 1 - 3-1/4" stem | 1 gram dried &wet | 4-6 hours 1-2 hours | plunge & hold down several times | 1-2 hours | 10 |
| 8 | DECEPTIVE MILKY, large, rounded cap, sunken V-shaped, white dried, one piece, 2 - 10" wide, 1-5/8 - 3-1/2 stem | 1 gram dried &wet | 4-6 hours 1-2 hours | plunge & hold down several times | 1-2 hours | 10 |
| 9 | SHORT STALKED WHITE RUSSULA, wide cap, convex edge, center V-shaped, one piece, dried, 4-8" wide, 1 - 3" stem, white gills | 1 gram dried &wet | 4-6 hours 1-2 hours | plunge & hold down several times | 1-2 hours | 9 |
| 10 | FIRM RUSSULA, dull redish orange, large cap, can see gills when looking at it, smooth surface, 1-3/8 - x 7" wide, 1 - 5" stalk, white to pale gills | 1 gram dried &wet | 4-6 hours 1-2 hours | plunge & hold down several times | 1-2 hours | 9 |
| 11 | ORANGE LATEX MILKY, orange, sunken center, rounded edge, dried, one piece, 2-5-1/2, 1/1/4-2-3/4 stem | 1 gram dried &wet | 4-6 hours 1-2 hours | plunge & hold down several times | 1-2 hours | 9 |
| 12 | GRAYING YELLOW RUSSULA, yellow cap, converted to sunken at center, white gills | 1 gram dried &wet | 4-6 hours 1-2 hours | plunge & hold down several times | 1-2 hours | 9 |

| | FIGURE 3 | SIZE | Time non-squished mushroom soaks in water before use | Amount of squishing | Time squished mushroom soaks in the boiling water before use | Rating |
|---|---|---|---|---|---|---|
| 13 | GILLED BOLETTE, conver to expanded V-shaped, yellow flesh, dried, 1-3" wide, 1-5/8 - 3-3/4" stem | 1 gram dried &wet | 4-6 hours 1-2 hours | plunge & hold down several times | 1-2 hours | 8 |
| 14 | SHELLFISH SCENTED RUSSULA, large redish cap converted to flat with sunken center, flesh is white, dried, 2" stem, 1 - 6" wide, 2 - 3" stalk | 1 gram dried &wet | 4-6 hours 1-2 hours | plunge & hold down several times | 1-2 hours | 9 |
| 15 | DUSTY WAXY CAP, brown cap, cream color gills | 1 gram dried &wet | 4-6 hours 1-2 hours | plunge & hold down several times | 1-2 hours | 9 |
| 16 | RED CAPPED SCABER STALK, 2 - 8" cap, 4 - 7" stem, orange red top, off spongy looking pores | 1 gram dried &wet | 4-6 hours 1-2 hours | plunge & hold down several times | 1-2 hours | 9 |
| 17 | ASPEN SCABER STALK, 1-5/8 - 6" CAP, 3-1/8 - 4-3/4" stem redish to orange - brown cap | 1 gram dried &wet | 4-6 hours 1-2 hours | plunge & hold down several times | 1-2 hours | 9 |
| 18 | COMMON SCABER STALK, 1-5/8 - 4" cap, 2-3/4 - 6" stem brown cap, off white gills | 1 gram dried &wet | 4-6 hours 1-2 hours | plunge & hold down several times | 1-2 hours | 9 |
| 19 | YELLOW CRACKED BOLETE, 2 - 8" cap, 1–5/8 - 4" stem olive to brown, fleah pale yellow | 1 gram dried &wet | 4-6 hours 1-2 hours | plunge & hold down several times | 1-2 hours | 8 |
| 20 | KING BOLETE, 3-1/4 - 10" cap, 4 - 10" stalk, large reddish brown cap, spongy | 1 gram dried &wet | 4-6 hours 1-2 hours | plunge & hold down several times | 1-2 hours | 8 |
| 21 | SLIPPERY JACK, 2 - 4-3/4" cap, 1-1/4 - 3-1/4" stalk, spongy brownish red cap, spongy gills | 1 gram dried &wet | 4-6 hours 1-2 hours | plunge & hold down several times | 1-2 hours | 8 |
| 22 | FROST'S BOLETE, 2 - 6" cap, yellow flesh, 1-5/8 - 4-3/4" stem | 1 gram dried &wet | 4-6 hours 1-2 hours | plunge & hold down several times | 1-2 hours | 8 |
| 23 | RED CRACKED BOLETE, 1-1/4 - 3-1/4"cap, olive brownish cap, yellow flesh, cracks are red, 1-5/8 - 2-3/8" stem | 1 gram dried &wet | 4-6 hours 1-2 hours | plunge & hold down several times | 1-2 hours | 8 |
| 24 | CHANTERELLE, 1 -4" cap, funnel shaped, 1 - 4" stalk, orange to yellow thick flesh | 1 gram dried &wet | 4-6 hours 1-2 hours | plunge & hold down several times | 1-2 hours | 6 |

| | FIGURE 4 | SIZE | Time non-squished mushroom soaks in water before use | Amount of squishing | Time squished mushroom soaks in the boiling water before use | Rating |
|---|---|---|---|---|---|---|
| 25 | SMOOTH VOLVARIBLLA, 2 - 6" cap, 3-1/2 - 8" stalk, white cap, pink gills, dull white | 1 gram dried &wet | 4-6 hours | plunge & hold down several times | 1-2 hours | 8 |
| 26 | MEADOW MUSHROOMS, 1 - 4" cap, 1 - 2" stalk, convex to flat, brown gills | 1 gram dried &wet | 4-6 hours | plunge & hold down several times | 1-2 hours | 9 |
| 27 | SHAGGY MANE, 1-1/4 - 2" wide, 1-5/8 - 6" high, cylindrical fresh | 1 gram dried &wet | 4-6 hours | plunge & hold down several times | 1-2 hours | 2 |
| 28 | YELLOW MOTEL, 1-5/8 - 2" wide cap, 1 - 2" stalk, yellow & brown honey comb look | 1 gram dried &wet | 4-6 hours | plunge & hold down several times | 1-2 hours | 9 |
| 29 | HORSE MUSHROOM, 3 - 6" CAP, 3 - 5" stalk, smooth white with some brown, brown gills | 1 gram dried &wet | 4-6 hours | plunge & hold down several times | 1-2 hours | 8 |
| 30 | SPRING AGARICUS, 2 - 6" cap, 1 - 2" stalk, grayish pink gills fibrous | 1 gram dried &wet | 4-6 hours | plunge & hold down several times | 1-2 hours | 9 |
| 31 | GYPSY, 2 - 6" cap, 2 - 4-3/4" stalk, gills off white, tan cap | 1 gram dried &wet | 4-6 hours | plunge & hold down several times | 1-2 hours | 8 |
| 32 | SWOLLEN STALKED CAT, 3 - 6" cap, 2 - 5" stem, dry, smooth off white to greyish, patchy on cap some | 1 gram dried &wet | 4-6 hours | plunge & hold down several times | 1-2 hours | 8 |
| 32 | RED & BLACK RUSSULA, 2-1/2 - 7" wide, 1-5/8 - 3-1/4 stem, flat with sunken center, bruises turn red, blackish top | 1 gram dried &wet | 4-6 hours | plunge & hold down several times | 1-2 hours | 9 |
| 34 | POPLAR TRICH, 2 - 6" wide, 1 - 3" stalk, flat to up-turned, wavy, reddish brown | 1 gram dried &wet | 4-6 hours | plunge & hold down several times | 1-2 hours | 8 |
| 35 | PORTPBELLO, (common table mushroom) | 1 gram dried &wet | 4-6 hours | plunge & hold down several times | 1-2 hours | 7 |
| 36 | CREMINI, (common table mushroom) | 1 gram dried &wet | 4-6 hours | plunge & hold down several times | 1-2 hours | 6 |

| | FIGURE 5 | SIZE | Time non-squished mushroom soaks in water before use | Amount of squishing | Time squished mushroom soaks in the boiling water before use | Rating |
|---|---|---|---|---|---|---|
| 37 | WHITE OR BUTTON, (common table mushroom) | 1 gram dried &wet | 4-6 hours | plunge & hold down several times | 1-2 hours | 7 |
| 38 | OYSTER, (common table mushroom) | 1 gram dried &wet | 4-6 hours | plunge & hold down several times | 1-2 hours | 6 |
| 38 | MAITAKE, (common table mushroom) | 1 gram dried &wet | 4-6 hours | plunge & hold down several times | 1-2 hours | 6 |
| 40 | PORCINI | 1 gram dried &wet | 4-6 hours | plunge & hold down several times | 1-2 hours | 6 |
| 41 | ENOKI-SMALL WHITE, (common table mushroom) | 1 gram dried &wet | 4-6 hours | plunge & hold down several times | 1-2 hours | 3 |
| 42 | REISHI | 1 gram dried &wet | 4-6 hours | plunge & hold down several times | 1-2 hours | 8 |

PROCEDURE TO ACQUIRE CLEANING AGENT

BACKGROUND OF THE INVENTION

Field of the Invention

The present invention relates to a method for making a cleaning agent, and more particularly, a method for making an organic cleaning agent that is useful for a plurality of cleaning tasks.

Description of the Prior Art

Many individuals live in homes. These homes need cleaning from time to time. Many people cleaning these homes are inclined to use a multitude of cleaning solutions to complete the chore. The majority of households have two or more different cleaning compounds to clean diverse surfaces.

Surfaces found in the home are most often difficult to clean due to imperfections typically present. Some imperfections may include cracks, divots, grout lines, porous contours, irregular textures, and the like.

Traditional cleaning products often contain harsh chemicals, are expensive, and may be dangerous to use. There are also occurrences of certain people being allergic to the compounds present in these cleaners, rendering the individual unable to use them. A safe cleaner is desired for use.

Many cleaners use complex chemicals to remove dirt, grime, grease, soap scum, mildew, and the like. When using some of these chemicals, it is sometimes necessary to wear protective gloves and a face mask to avoid skin and lung initiation.

In many instances while taking on a cleaning project homeowners often have to experiment with different cleaning solutions. Several cleaning products may need to be used to clean a house. The potential for mixing of dangerous chemicals may be present, which may cause injury or health problems when inhaled. It is, therefore, desirable to have a single universal cleaning solution with an environmentally friendly compound that is also hypoallergenic, yet concentrated enough to complete tough cleaning tasks.

Preferably, a cleaning product should provide an all-in-one non-harmful, hypoallergenic, and potent cleaning solution, and yet, operates reliably and is manufactured at a modest expense. Thus, a need exists for a reliable all-purpose cleaner systems to avoid the above-mentioned problems.

Numerous innovations for cleaning agents have been provided in the prior art that will be described. Even though these innovations may be suitable for the specific individual purposes to which they address, however, they differ from the present invention.

A FIRST EXAMPLE, U.S. Pat. No. 3,817,875, Published/Issued on Jun. 18, 1974, to Bazán teaches a heavy-duty and multi-purpose cleaner containing the following active ingredients: A. Approximately 73% by weight of a combination of ammonium oxalate, hexachlorophene, 2,2'-methylene-bis-(3,4,6-Trichlorophenol) and ammoniumethylene diamine tetraacetate in the approximate ratio of 6:1.5:1, with a minor amount of ammonium ortho-phenylphenate; B. Approximately 20% by weight of a tertiary N-higher alkyl-deimethylbenzyl ammonium chloride combined with anhydrous sodium metasikicate in the ratio of 2:3; and C. Approximately 5% by weight of waste.

A SECOND EXAMPLE, U.S. Pat. No. 3,839,234, Published/Issued on Oct. 1, 1974, to Roscoe teaches a water miscible cleaning composition containing a glycol ether, such as, ethylene glycol monobutly ether, diethylene glycol monobutyl ether, ethylene glycol monomethyl ether, ethylene glycol monoethyl ether, diethylene glycol monomethyl ether, or diethylene glycol monoethyl ether. A glycol, such as, propylene glycol, diethylene glycol, hexylene glycol (2-methyl-2, 4 pentanediol), triethylene glycol, or dipropylene glycol. A monohydroxy alcohol, such as, isopropanol, n-propanol, or isobutanol. Ammonium hydroxide. An amine, such as, triethanolamine, monoethanolamine, diethanolamine, monoisopropanolamine, diisopropanolamine, triisopropanolamine, monomethylamine, dimethylamine, ethylenediamine, propylenediamine, cyclohexylamine, diethylethanolamine, ethyl diethanolamine, or morpholine. A synthetic detergent.

A THIRD EXAMPLE, U.S. Pat. No. 4,311,608, Published/Issued on Jan. 19, 1982, to Maurice teaches a cleaning solution including isopropyl alcohol, linear dodecylbenzene sulfonic acid, a primary alcohol containing 9 to 11 carbon atoms and an average of about 6 moles of ethylene oxide per mole of alcohol, a primary alcohol containing 9 to 11 carbon atoms and an average of about 2.5 moles of ethylene oxide per mole of alcohol, sodium lauryl sulfate and dy-methol poly siloxane emulsified in water.

A FOURTH EXAMPLE, U.S. Pat. No. 6,384,010, Published/Issued on May 7, 2002, to Wagers teaches an all purpose cleaner for hard surfaces, which includes an aqueous solution of a secondary alcohol ethoxylate surfactant, an alkylpolyglycoside surfactant, and water, optionally including a chelating agent and a sufficient pH modification agent to provide an alkaline solution. The ethoxylate surfactants, preferably, have HLB values of from 12.2 to 14.6, and each surfactant may include up to about 5 weight percent of the solution. The solution may be essentially free of organic solvents, such as, alkylene glycol or alkylene glycol ethers, or other volatile organic compounds. As a result, the solution may be fragrance free, and, if so desired, colorless. Optionally, however, the cleaning solution may contain fragrances, coloring agents, anti-bacterials, stabilizers, preservatives, and other constituents, including a minor amount of a co-surfactant.

A FIFTH EXAMPLE, U.S. Pat. No. 5,075,026, Published/Issued on Dec. 24, 1991, to Loth et al. teaches a microemulsion compositions containing an anionic detergent, one of the specified cosurfactants, a hydrocarbon ingredient and water, which includes the use of a water-insoluble odoriferous perfume as the essential hydrocarbon ingredient in a proportion sufficient to form either a dilute o/w microemulsion composition containing, by weight, 1% to 10% of an anionic detergent, 2% to 10% of cosurfactant, 0.4% to 10% of perfume and the balance water or a concentrated microemulsion composition containing, by weight, 18% to 65% of anionic and nonionic detergent, 2% to 30% of cosurfactant, 10% to 50% of perfume and the balance water which upon dilution with water will yield the dilute o/w microemulsion composition.

A SIXTH EXAMPLE, U.S. Pat. No. 8,741,827, Published/Issued on Jun. 3, 2014, to Vyrostko et al. teaches a multi-purpose cleaning compound including about 4.50% to about 16.50% by volume isopropyl alcohol; about 4.50% to about 16.50% by volume vinegar; about 2.00% and about 8.50% by volume ammonia; about 2.00% by volume of at least one pre-selected surfactant; between about 0.009% and about 0.05% by volume rosemary oil; and about 56.50% and about 86.90% by volume water.

A SEVENTH EXAMPLE, U.S. Patent Office Document No. 2005/0020473, Published/Issued on Jan. 27, 2005 to Gallotti et al. teaches a liquid all-purpose cleaning composition that is suitable for cleaning hard surfaces, such as, plastic, vitreous, metal, and glass. The liquid all-purpose cleaner of the present invention includes an aqueous composition including water, non-ionic and/or anionic surfactants, optional amphoteric surfactants, and cationic compounds.

AN EIGHTH EXAMPLE, Canadian Patent Office Document No. CA 2,724,642, Published/Granted on Nov. 26, 2011 to Toussaint et al. teaches surfactant-based and all-purpose cleaners useful for cleaning surfaces including household hard surfaces as well as glass. The cleaning compositions include an anionic sulfonate surfactant, a non-ionic aliphatic ethoxylated surfactant, an alcohol, and a residue-reducing agent. The cleaning compositions are effective in removing soils, such as, greasy soil and in leaving un-rinsed or unwiped surfaces residue free.

AN NINTH EXAMPLE, Canadian Patent Office Document No. CA 2,412,820, Published/Granted on Aug. 21, 2008 to Wagers et al. teaches an all purpose cleaner for hard surfaces includes an aqueous solution of a secondary alcohol ethoxylate surfactant, an alkylpolyglycoside surfactant, and water, optionally including a chelating agent and sufficient pH modification agent to provide an alkaline solution. The ethoxylate surfactants, preferably, have HLB values of from 12.2 to 14.6, and each surfactant may include up to about 5 weight percent of the solution. The solution may be essentially free of organic solvents, such as, alkylene glycol or alkylene glycol ethers, or other volatile organic compounds. As a result, the solution may be fragrance free, and, if so desired, colorless. Optionally, however, the cleaning solution may contain fragrances, coloring agents, anti-bacterials, stabilizers, preservatives, and other constituents, including a minor amount of a co-surfactant.

A TENTH EXAMPLE, Canadian Patent Office Document No. CA 2,633,163, Published/Granted on Nov. 19, 2013 to Thomson teaches compositions including an alkanesulfonic acid and an organic nitrogenous base, and related methods of use.

AN ELEVENTH EXAMPLE, Canadian Patent Office Document No. CA 2,205,404, Published/Granted on May 23, 1996 to Loth et al. teaches a liquid crystal composition or the microemulsion compositions more environmentally friendly, which is especially effective in the removal of oily and greasy soil and having an evidenced grease release effect, which contains an anionic detergent, an ethoxylated glycerol type compound, a hydrocarbon ingredient, and water including the use of a water-insoluble odoriferous perfume as the essential hydrocarbon ingredient in a proportion sufficient to form either a dilute o/w microemulsion composition containing, by weight, 1% to 20% of an anionic surfactant, 0.1% to 50% of a cosurfactant, 0.1% to 20% of an ethoxylated glycerol type compound, 0.4% to 10% of perfume and the balance being water.

A TWELFTH EXAMPLE, Canadian Patent Office Document No. CA 2,821,327, Published/Granted on Jun. 21, 2012 to Hill et al. teaches a multipurpose cleaner composition including a soluble silicate, a surfactant, a polyol, and water. The multipurpose cleaner composition is generally intended for cleaning schools, offices, homes, and other locations, and in particular, all types of surfaces including wood, carpet, tile, concrete, and glass. In one embodiment, the soluble silicate of the multipurpose cleaner composition has a mole ratio of at least 2.5 moles of silicate per mole of alkali metal oxide. In another embodiment, the multipurpose cleaner composition will have a pH level ranging from about 10.5 to about 1 1.9. In another embodiment, the multipurpose cleaner composition may be further diluted by adding water to create various solutions including about 1 part water to 1 part multipurpose cleaner composition up to about 500 parts water to 1 part multipurpose cleaner composition.

A THIRTEENTH EXAMPLE, Chinese Patent Office Document No. CN 104277936, Published/Granted on Jan. 14, 2015 to Yuan teaches a pure, natural, and multi-functional cleaning fluid that can be used for cleaning dust, greasy dirt, impurities, and the like on computer liquid crystal displays, camera lenses of digital cameras, mobile phone screens, glasses for near-sighted persons, sunglasses, and polarizers. The pure, natural, and multi-functional cleaning fluid is prepared from the following components: sweater extracting liquid, citrate, chitosan, ethyl alcohol, menthol, borneol, borate, sodium chloride, a disinfectant, and deionized water. The pure, natural, and multi-functional cleaning fluid has extremely strong cleaning and bacteria-removing effects, is used for sterilizing and disinfecting, cleaning and defouling screens or shell surfaces of products, can be used for forming a protective film to achieve bacteriostatic action, and is a natural multi-functional detergent that is free of a petrochemical component, and belongs to an environment-friendly product.

A FOURTEENTH EXAMPLE, Canadian Patent Office Document No. CA 2,007,812, Published/Granted on Apr. 18, 1995 to Jimmy teaches a stable, acidic disinfectant, and all-purpose liquid cleaning composition, free of detergent builders and substantially free of organic solvents, which includes a mixture of acid stable water-soluble and water-dispersible nonionic surfactants, organic acid and a water soluble, acid stable disinfectant compound in an aqueous medium. The composition spreads quickly and provides good detergency with efficient penetration of soils, while maintaining a high level of disinfectant activity. A soil releasing agent may also be included in the composition in order to provide easier cleaning of the treated surface during subsequent cleaning operations. The composition is particularly effective for cleaning soap scum and mineral deposits from hard surfaces such as grout, ceramic tile, stainless steel, and glass.

A FIFTEENTH EXAMPLE, Canadian Patent Office Document No. CA 2,126,269, Published/Granted on Sep. 24, 1995 to Haley teaches concentrated all-purpose liquid cleaning compositions that contain high levels of surfactants and solvents and exhibit improved cleaning performance and homogeneity in solution. A preferred formulation incorporates an actives system of a three component mixture: an anionic surfactant, such as, alkyl ethoxy sulfates, alkyl ethoxy carboxylates and mixtures thereof, a nonionic surfactant, such as, fatty alcohol ethoxylates, nonylphenol ethoxylates, alkylpolyglycosides and mixtures thereof, a glycol ether solvent, and the balance including water and optional ingredients to provide a concentrated cleaning composition that can be diluted by the end user to the desired strength. Another preferred embodiment teaches a method of using a concentrated liquid cleaning composition.

It is apparent now that numerous innovations for cleaning agents have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a method for making an organic cleaning agent that is useful for a plurality of cleaning tasks that avoids the disadvantages of the prior art.

ANOTHER OBJECT of the present invention is to provide a method for making an organic cleaning agent that is useful for a plurality of cleaning tasks that is simple and inexpensive to manufacture.

STILL ANOTHER OBJECT of the present invention is to provide a method for making an organic cleaning agent that is useful for a plurality of cleaning tasks that is simple to use.

BRIEFLY STATED, STILL YET ANOTHER OBJECT of the present invention is to provide a method for making an organic cleaning agent that is useful for a plurality of cleaning tasks, which includes the steps of picking a specific edible mushroom with a specific size, soaking the specific edible mushroom in water without squishing for a specific amount of time so as to form a soaked and unsquished mushroom, squishing the soaked and unsquished mushroom a specific amount so as to form a squished mushroom, and soaking the squished mushroom in boiling water for a specific amount of time so as to form a treated liquid, so that the treated liquid formed thereby is the organic cleaning agent.

As shown in FIGS. 6 and 7, the surfaces 32,34 able to be cleaned are at least glass, tile, brick, wood, leather, porcelain, skin, plastic, stone, ferrous material, non-ferrous material, etc. by cleaning the surfaces of iron-oxide, grease, dust, and other contaminates. Furthermore, the all-purpose cleaner composition is beneficial in that it is non-toxic to use.

The all-purpose cleaner composition compound breaks down dirt, grease, rust, toilet rings, leftover food particles, hard water residue, soap scum, and the like.

Some additional benefits using the all-purpose cleaner system is a non-toxic and hypo-allergenic compound that provides the ability to use the cleaner safely on the skin and items worn on the body, such as, clothes and jewelry.

The mushroom base formula is safe to use on a plurality of items other cleaners would destroy, such as, a set of dentures. The present invention also relates to cleaning or disinfecting wounds, amputations, psoriasis, and skin disorders. The present invention also clears up itchy eyes. The present invention also cleans the scalp and stops hair loss. The present invention also is a tooth whitener. Many other applications apply for general cleaning of items.

The all-purpose cleaner composition replaces harsh chemical cleaners often found in the home, and is more economical and environmentally safe. The all-purpose cleaner composition comprises a cleaning solution that saves time, energy, and space. The all-purpose cleaner composition is a ready to use solution that requires no pre-mixing before use, can be dispensed right from the container, and is safe to use.

The all-purpose cleaner system is for use in many different types of cleaning tasks. The all-purpose cleaner contains a mushroom-base compound that is used to clean multiple areas in the home, as well as, being safe for use on the body. This cleaner is non-toxic and hypoallergenic, however, remains concentrated enough to cut through different types of grime. The all-purpose cleaner replaces costly harsh chemical alternatives. When cleaning with the all-purpose cleaner, created with a non-toxic compound, the user no longer needs protective apparel while handling.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

The figures of the drawing are briefly described as follows:

FIGS. 1A-1B are a flowchart of the method for making an organic cleaning agent that is useful for a plurality of cleaning tasks;

FIG. 2 is a tabulation of tests on examples 1-12;

FIG. 3 is a tabulation of tests on examples 13-24;

FIG. 4 is a tabulation of tests on examples 25-36;

FIG. 5 is a tabulation of tests on examples 37-42;

A MARSHALING OF REFERENCE NUMERALS UTILIZED IN THE DRAWINGS

Introductory

Figure 6:
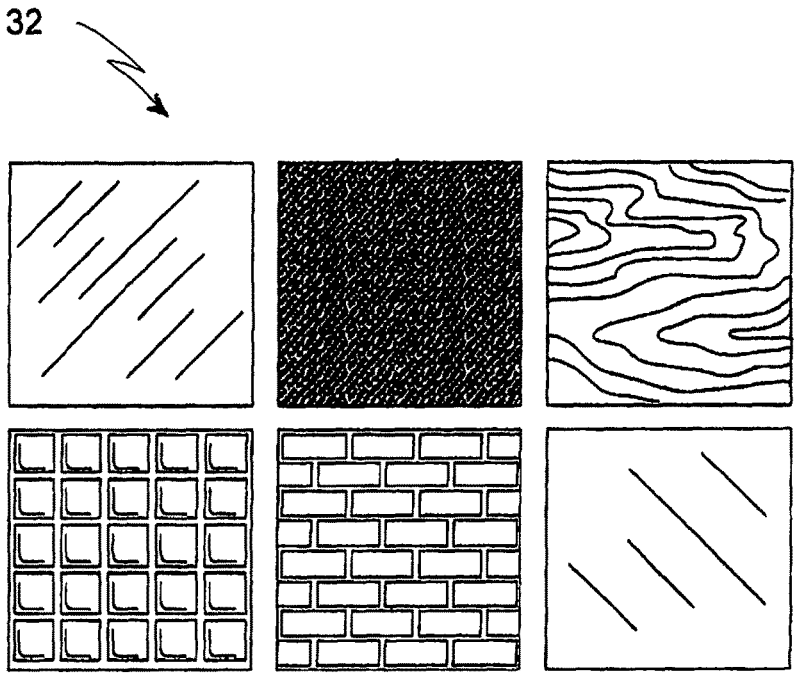
FIG. 6 is a diagrammatic top plan view of the different surfaces the all-purpose cleaner system according to an embodiment of the present invention made by the method of FIGS. 1A-1B can clean.
Figure 7:
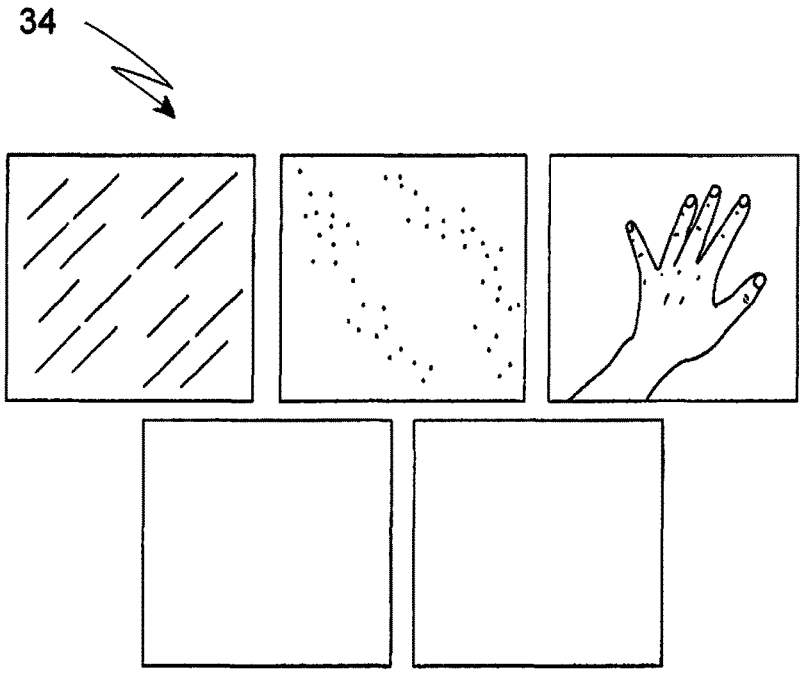
FIG. 7 a diagrammatic top plan view of additional different surfaces the all-purpose cleaner system according to an embodiment of the present invention made by the method of FIGS. 1A-1B can clean.

10 method for making organic cleaning agent 12 that is useful for a plurality of cleaning tasks
12 organic cleaning agent

Method 10 for Making Organic Cleaning Agent 12

14 specific edible mushroom
16 specific size of specific edible mushroom 14
18 water
20 specific amount of time of soaking specific edible mushroom 14 in water 18 without squishing
22 soaked and unsquished mushroom
24 specific amount of squishing of soaked and unsquished mushroom 22
26 squished mushroom
28 boiling water
30 specific amount of time of soaking squished mushroom 26 in boiling water 28
32 six surfaces the all-purpose cleaner system according to an embodiment of the present invention made by the method of FIGS. 1A-1B can clean
34 five surfaces the all-purpose cleaner system according to an embodiment of the present invention made by the method of FIGS. 1A-1B can clean

DETAILED DESCRIPTION OF THE PREFERRED EMBODIMENTS

Introductory

Referring now to FIGS. 1A-1B, the method of the embodiments of the present invention is shown generally at 10 for making an organic cleaning agent 12 that is useful for a plurality of cleaning tasks.

Method 10 for Making the Organic Cleaning Agent 12 that is Useful for a Plurality of Cleaning Tasks The method 10 for making the organic cleaning agent 12 that is useful for a plurality of cleaning tasks can best be seen in FIGS. 1A-1B, and as such, will be discussed with reference thereto.

The method 10 for making the organic cleaning agent 12 that is useful for a plurality of cleaning tasks comprises the steps of:

STEP 1: choosing a specific edible mushroom 14 with a specific size 16;

STEP 2: soaking the specific edible mushroom 14 in water 18 without squishing for a specific amount of time 20 so as to form a soaked and unsquished mushroom 22;

STEP 3: squishing the soaked and unsquished mushroom 22 a specific amount 24 so as to form a squished mushroom 26; and STEP 4: soaking the squished mushroom 26 in boiling water 28 for a specific amount of time 30 so as to form a treated liquid, so that the treated liquid formed thereby is the organic cleaning agent.

Test Data on Examples of the Organic Cleaning Agent 12

The test data on the examples of the organic cleaning agent 12 can best be seen in FIGS. 2-5, and as such, will be discussed with reference thereto Test 1

One half of a free morel mushroom in an amount weighing 1 gram when dried or wet was chosen. The free morel mushroom has a brownish, smooth, and irregular cap, is dried, is hollow, is ⅜" to 1⅝" high or wide, has a ¾" to 4" stem, and a honeycomb look. The one half of the free morel mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $1^{st}$ embodiment of the organic cleaning agent having a success rating of 10 out of 10 or 100%, as shown in Test 1 of FIG. 2.

Test 2

One black morel mushroom in an amount weighing 1 gram when dried or wet was chosen. The black morel mushroom is hollow and dry, is ⅜" to 1⅝ " wide, and is ¾" to 2" high. The one black morel mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $2^{nd}$ embodiment of the organic cleaning agent having a success rating of 10 out of 10 or 100%, as shown in Test 2 of FIG. 2.

Test 3

One shitake mushroom in an amount weighing 1 gram when dried or wet was chosen. The shitake mushroom is dry. The one shitake mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $3^{rd}$ embodiment of the organic cleaning agent having a success rating of 9 out of 10 or 90%, as shown in Test 3 of FIG. 2.

Test 4

A piece of western giant riffball mushroom in an amount weighing 1 gram when dried or wet was chosen. The western giant riffball mushroom is dry, is white, and is spherical-shaped. The piece of western giant riffball mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $4^{th}$ embodiment of the organic cleaning agent having a success rating of 6 out of 10 or 60%, as shown in Test 4 of FIG. 2.

Test 5

One piece of a giant riffball mushroom in an amount weighing 1 gram when dried or wet was chosen. The giant riffball mushroom is dry, is white, is spherical-shaped, is huge, and is smooth. The one piece of the western giant riffball mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 5th embodiment of the organic cleaning agent having a success rating of 6 out of 10 or 60%, as shown in Test 5 of FIG. 2.

Test 6

A piece of a giant clitocybe mushroom in an amount weighing 1 gram when dried or wet was chosen. The giant clitocybe mushroom is whitish, dry, smooth and funnelled is 4" to 18" wide, and has a ¼" stalk. The piece of the giant clitocybe mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $6^{th}$ embodiment of the organic cleaning agent having a success rating of 10 out of 10 or 100%, as shown in Test 6 of FIG. 2.

Test 7

One piece of a willow milky mushroom in an amount weighing 1 gram when dried or wet was chosen. The willow milky mushroom has a large cap, pinkish gills, is V-shaped and dry, is 1⅝" to 9" wide, and has a 1" to 3¼" stem. The one piece of the willow milky mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom.

The squished mushroom is soaked in boiling water for 1-2 hours. The liquid result is a $7^{th}$ embodiment of the organic cleaning agent having a success rating of 10 out of 10 or 100%, as shown in Test 7 of FIG. 2.

Test 8

One piece of a deceptive milky mushroom in an amount weighing 1 gram when dried or wet was chosen. The deceptive milky mushroom has a large and rounded cap, is sunken, is V-shaped, is white, is dry, is 2" to 10" wide, and has a ⅛" to 3½" stem. The one piece of the deceptive milky mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is an $8^{th}$ embodiment of the organic cleaning agent having a success rating of 10 out of 10 or 100%, as shown in Test 8 of FIG. 2.

Test 9

One piece of a short stalked white russula mushroom in an amount weighing 1 gram when dried or wet was chosen. The short stalked white russula mushroom has a wide cap, white gills, and a convex edge, is sunken V-shaped, is dry, is 4" to 8" wide, and has a 1" to 3" stem. The one piece of the short stalked white russula mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $9^{th}$ embodiment of the organic cleaning agent having a success rating of 9 out of 10 or 90%, as shown in Test 9 of FIG. 2.

Test 10

A firm russula mushroom in an amount weighing 1 gram when dried or wet was chosen. The firm russula mushroom has a large cap, white to pale gills, a smooth surface, is dull reddish orange, is 1⅜" to 7" wide, and has a 1" to 5" stalk. The firm russula mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $10^{th}$ embodiment of the organic cleaning agent having a success rating of 9 out of 10 or 90%, as shown in Test 10 of FIG. 2.

Test 11

One piece of an orange latex milky mushroom in an amount weighing 1 gram when dried or wet was chosen. The orange latex milky mushroom is orange and dried, and has a sunken center, a rounded edged, and a 2" to 5½" or a 1¼" to 2¾" stem. The one piece of the orange latex milky mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is an $11^{th}$ embodiment of the organic cleaning agent having a success rating of 9 out of 10 or 90%, as shown in Test 11 of FIG. 2.

Test 12

A graying yellow russula mushroom in an amount weighing 1 gram when dried or wet was chosen. The graying yellow russula mushroom has a yellow cap, is converted to sunken at center, and has white gills. The graying yellow russula mushroom one is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $12^{th}$ embodiment of the organic cleaning agent having a success rating of 9 out of 10 or 90%, as shown in Test 12 of FIG. 2.

Test 13

A gilled bolette mushroom in an amount weighing 1 gram when dried or wet was chosen. The gilled bolette mushroom is converted to an expanded V-shaped, has a yellow flesh, is dry, is 1"-3" wide, and has a 1⅝"-3¾" stem. The gilled bolette mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $13^{th}$ embodiment of the organic cleaning agent having a success rating of 8 out of 10 or 80%, as shown in Test 13 of FIG. 3.

Test 14

A shellfish scented russula mushroom in an amount weighing 1 gram when dried or wet was chosen. The shellfish scented russula mushroom has a large reddish cap converted to flat with a sunken center, has white flesh, is dried, is 1"-6" wide, and has a 2" stem and a 2"-3" stalk. The shellfish scented russula mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a $14^{th}$ embodiment of the organic cleaning agent having a success rating of 9 out of 10 or 90%, as shown in Test 14 of FIG. 3.

Test 15

A dusty waxy cap mushroom in an amount weighing 1 gram when dried or wet was chosen. The dusty waxy cap mushroom has a brown cap and cream color gills. The dusty waxy cap mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 15$^{th}$ embodiment of the organic cleaning agent having a success rating of 9 out of 10 or 90%, as shown in Test 15 of FIG. 3.

Test 16

A red capped scaber stalk mushroom in an amount weighing 1 gram when dried or wet was chosen. The red capped scaber stalk mushroom has an orange red top, off spongy looking pores, a 2"-8" cap, and a 4"-7" stem. The red capped scaber stalk mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 16$^{th}$ embodiment of the organic cleaning agent having a success rating of 9 out of 10 or 90%, as shown in Test 16 of FIG. 3.

Test 17

An aspen scaber stalk mushroom in an amount weighing 1 gram when dried or wet was chosen. The aspen scaber stalk mushroom has a brown cap, a reddish to orange stem, a 1⅝"-6" cap, and a 3⅛"-4¾" stem. The aspen scaber stalk mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 17$^{th}$ embodiment of the organic cleaning agent having a success rating of 9 out of 10 or 90%, as shown in Test 17 of FIG. 3.

Test 18

A common scaber stalk mushroom in an amount weighing 1 gram when dried or wet was chosen. The common scaber stalk mushroom has a brown cap, off white gills, a 1⅝"-4" cap, and a 2¾"-6" stem. The common scaber stalk mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is an 18$^{th}$ embodiment of the organic cleaning agent having a success rating of 9 out of 10 or 90%, as shown in Test 18 of FIG. 3.

Test 19

A yellow cracked bolete mushroom in an amount weighing 1 gram when dried or wet was chosen. The yellow cracked bolete mushroom has a 2"-8" cap, a flesh pale yellow color, with a 1⅝"-4" olive to brown colored stem. The yellow cracked bolete mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 19$^{th}$ embodiment of the organic cleaning agent having a success rating of 8 out of 10 or 80%, as shown in Test 19 of FIG. 3.

Test 20

A king bolete mushroom in an amount weighing 1 gram when dried or wet was chosen. The king bolete mushroom is spongy, and has a large reddish brown 3¼"-10" cap, and a 4"-10" stalk. The king bolete mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 20$^{th}$ embodiment of the organic cleaning agent having a success rating of 8 out of 10 or 80%, as shown in Test 20 of FIG. 3.

Test 21

A slippery jack mushroom in an amount weighing 1 gram when dried or wet was chosen. The slippery jack mushroom has a spongy brownish red 2"-4¾" cap, spongy gills, and a ¼"-3¼" stalk. The slippery jack mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 21$^{st}$ embodiment of the organic cleaning agent having a success rating of 8 out of 10 or 80%, as shown in Test 21 of FIG. 3.

Test 22

A frost's bolete mushroom in an amount weighing 1 gram when dried or wet was chosen. The frost's bolete mushroom has a yellow flesh, a 2"-6" cap, and a 1⅝"-4¾" stem. The frost's bolete mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 22$^{nd}$ embodiment of the organic cleaning agent having a success rating of 8 out of 10 or 80%, as shown in Test 22 of FIG. 3.

Test 23

A red cracked bolete mushroom in an amount weighing 1 gram when dried or wet was chosen. The red cracked bolete mushroom has a yellow flesh, red cracks, a 1¼ "-3¼ " olive brownish colored cap, and a 1⅝"-2⅜" stem. The red cracked bolete mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 23$^{rd}$ embodiment of the organic cleaning agent having a success rating of 8 out of 10 or 80%, as shown in Test 23 of FIG. 3.

Test 24

A chanterelle mushroom in an amount weighing 1 gram when dried or wet was chosen. The chanterelle mushroom is funnel shaped, and has a 1"-4" cap, a 1"-4" stalk, and an orange to yellow thick flesh. The chanterelle mushroom is soaked in water without squishing for 4-6 hours if dry or 1-2 hours if wet so as to form a soaked and unsquished mushroom. The soaked and unsquished mushroom is squished by plunging or holding down several times so as to form a squished mushroom. The squished mushroom is soaked in boiling water for 1-2 hours. The liquid result is a 24$^{th}$ embodiment of the organic cleaning agent having a success rating of 6 out of 10 or 60%, as shown in Test 24 of FIG. 3.

Test 25

A smooth volvariblla mushroom in an amount weighing 1 gram when dried or wet was chosen. The smooth volvariblla mushroom is dull white and has pink gills, a 2"-6" white cap, and a 3½ " 8" stalk. The smooth volvariblla mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 25$^{th}$ embodiment of the organic cleaning agent having a success rating of 8 out of 10 or 80%, as shown in Test 25 of FIG. 4.

Test 26

A meadow mushroom in an amount weighing 1 gram dried or wet was chosen. The meadow mushroom is convex to flat, and has a 1"-4" cap, a 1"-2" stalk, and brown gills. The meadow mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 26$^{th}$ embodiment of the organic cleaning agent having a success rating of 9 out of 10 or 90%, as shown in Test 26 of FIG. 4.

Test 27

A shaggy mane mushroom in an amount weighing 1 gram dried or wet was chosen. The shaggy mane mushroom has cylindrica flesh, and is 1¼"-2" wide and is 1⅝"-6" high. The shaggy mane mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 27$^{th}$ embodiment of the organic cleaning agent having a success rating of 2 out of 10 or 20%, as shown in Test 27 of FIG. 4.

Test 28

A yellow motel mushroom in an amount weighing 1 gram dried or wet was chosen. The yellow motel mushroom has cylindrical flesh, a 1⅝%"-2" wide cap, a 1"-2" stalk, and a yellow and brown honey comb look. The yellow motel mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 28$^{th}$ embodiment of the organic cleaning agent having a success rating of 9 out of 10 or 90%, as shown in Test 28 of FIG. 4.

Test 29

A horse mushroom in an amount weighing 1 gram dried or wet was chosen. The horse mushroom has 3"-6" cap, 3"-5" stalk, a smooth white with some brown color, and brown gills. The horse mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 29$^{th}$ embodiment of the organic cleaning agent having a success rating of 8 out of 10 or 80%, as shown in Test 29 of FIG. 4.

Test 30

A spring agaricus mushroom in an amount weighing 1 gram dried or wet was chosen. The spring agaricus mushroom has a 2"-6" cap, a 3"-5" stalk, and is fibrous and has greyish pink gills. The spring agaricus mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 30$^{th}$ embodiment of the organic cleaning agent having a success rating of 9 out of 10 or 90%, as shown in Test 30 of FIG. 4.

Test 31

A gypsy mushroom in an amount weighing 1 gram dried or wet was chosen. The gypsy mushroom has a 2"-6" cap, a 2"-4¾" stalk, off white gills, and a tan cap. The gypsy mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 31$^{th}$ embodiment of the organic cleaning agent having a success rating of 8 out of 10 or 80%, as shown in Test 31 of FIG. 4.

Test 32

A swollen stalked cat mushroom in an amount weighing 1 gram dried or wet was chosen. The swollen stalked cat mushroom has a 3"-6" cap with some patches, a 2"-5" stem, and is dry, and is smooth off white to greyish color. The swollen stalked cat mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 32$^{nd}$ embodiment of the organic cleaning agent having a success rating of 8 out of 10 or 80%, as shown in Test 32 of FIG. 4.

Test 33

A red and black russula mushroom in an amount weighing 1 gram dried or wet was chosen. The red and black russula mushroom is 2½"-7" wide, is flat with a sunken center, turns red when bruised, and has a 1⅝"-3¼" stem and a blackish top. The red and black russula mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 33$^{rd}$ embodiment of the organic cleaning agent having a success rating of 9 out of 10 or 90%, as shown in Test 33 of FIG. 4.

Test 34

A poplar trich mushroom in an amount weighing 1 gram dried or wet was chosen. The poplar trich mushroom is 2"-6" wide, is reddish brown, is wavy, is flat to up-turned, and has a 1"-3" stalk. The poplar trich mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 34$^{th}$ embodiment of the organic cleaning agent having a success rating of 8 out of 10 or 80%, as shown in Test 34 of FIG. 4.

Test 35

A portabella mushroom in an amount weighing 1 gram dried or wet was chosen. The portabella mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 35$^{th}$ embodiment of the organic cleaning agent having a success rating of 7 out of 10 or 70%, as shown in Test 35 of FIG. 4.

Test 36

A cremini mushroom in an amount weighing 1 gram dried or wet was chosen. The cremini mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 36$^{th}$ embodiment of the organic cleaning agent having a success rating of 6 out of 10 or 60%, as shown in Test 36 of FIG. 4.

Test 37

A white or button mushroom in an amount weighing 1 gram dried or wet was chosen. The white or button mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 37$^{th}$ embodiment of the organic cleaning agent having a success rating of 7 out of 10 or 70%, as shown in Test 37 of FIG. 5.

Test 38

An oyster mushroom in an amount weighing 1 gram dried or wet was chosen. The oyster mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 38$^{th}$ embodiment of the organic cleaning agent having a success rating of 6 out of 10 or 60%, as shown in Test 38 of FIG. 5.

Test 39

A maitake mushroom in an amount weighing 1 gram dried or wet was chosen. The maitake mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 39$^{th}$ embodiment of the organic cleaning agent having a success rating of 6 out of 10 or 60%, as shown in Test 39 of FIG. 5.

Test 40

A porcini mushroom in an amount weighing 1 gram dried or wet was chosen. The porcini mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 40$^{th}$ embodiment of the organic cleaning agent having a success rating of 6 out of 10 or 60%, as shown in Test 40 of FIG. 5.

Test 41

An enoki-small white mushroom in an amount weighing 1 gram dried or wet was chosen. The enoki-small white mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 41$^{st}$ embodiment of the organic cleaning agent having a success rating of 3 out of 10 or 30%, as shown in Test 41 of FIG. 5.

Test 42

A reishi mushroom in an amount weighing 1 gram dried or wet was chosen. The reishi mushroom is soaked in water without squishing for 4-6 hours so as to form a soaked and unsquished mushroom. The soaked and unsquished mushroom is squished by plunging or holding down several times so as to form a squished mushroom. The squished mushroom is soaked in boiling water for 1-2 hours. The liquid result is a 42$^{nd}$ embodiment of the organic cleaning agent having a success rating of 8 out of 10 or 80%, as shown in Test 42 of FIG. 5.

Impressions

It will be understood that each of the elements described above, or two or more together, may also find a useful application in other types of constructions differing from the types described above.

While the invention has been illustrated and described as embodiments of a method for making an organic cleaning agent, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A method for making an organic cleaning agent, comprising the steps of:

a) picking a specific edible mushroom with a specific size;

b) soaking the specific edible mushroom in water without squishing for a specific amount of time so as to form a soaked and unsquished mushroom;

c) squishing the soaked and unsquished mushroom a specific amount so as to form a squished mushroom; and d) soaking the squished mushroom in boiling water for a specific amount of time so as to form a treated liquid, so that the treated liquid formed thereby is the organic cleaning agent.

2. The method of claim 1, wherein the specific amount of time of soaking the squished mushroom in boiling water is 1-2 hours.

3. The method of claim 2, wherein the specific amount of squishing the soaked and unsquished mushroom is by plunging or holding down several times.

4. The method of claim 3, wherein the specific amount of time of soaking the specific edible mushroom in the water is 4-6 hours if dry or 1-2 hours if wet.

5. The method of claim 4, wherein the specific edible mushroom is a half free morel mushroom.

6. The method of claim 4, wherein the specific edible mushroom is a black morel mushroom.

7. The method of claim 4, wherein the specific edible mushroom is a shitake mushroom.

8. The method of claim 4, wherein the specific edible mushroom is a western giant riffball mushroom.

9. The method of claim 4, wherein the specific edible mushroom is a giant riffball mushroom.

10. The method of claim 4, wherein the specific edible mushroom is a giant clitocybe mushroom.

11. The method of claim 4, wherein the specific edible mushroom is a willow milky mushroom.

12. The method of claim 4, wherein the specific edible mushroom is a deceptive milky mushroom.

13. The method of claim 4, wherein the specific edible mushroom is a short stalked white russula mushroom.

14. The method of claim 4, wherein the specific edible mushroom is a firm russula mushroom.

15. The method of claim 4, wherein the specific edible mushroom is an orange latex milky mushroom.

16. The method of claim 4, wherein the specific edible mushroom is a graying yellow russula mushroom.

17. The method of claim 4, wherein the specific edible mushroom is a gilled bolette mushroom.

18. The method of claim 4, wherein the specific edible mushroom is a shellfish scented russula mushroom.

19. The method of claim 4, wherein the specific edible mushroom is a dusty waxy cap mushroom.

20. The method of claim 4, wherein the specific edible mushroom is a red capped scaber stalk mushroom.

21. The method of claim 4, wherein the specific edible mushroom is an aspen scaber stalk mushroom.

22. The method of claim 4, wherein the specific edible mushroom is a common scaber stalk mushroom.

23. The method of claim 4, wherein the specific edible mushroom is a yellow cracked bolete mushroom.

24. The method of claim 4, wherein the specific edible mushroom is a king bolete mushroom.

25. The method of claim 4, wherein the specific edible mushroom is a slippery jack mushroom.

26. The method of claim 4, wherein the specific edible mushroom is a frost's bolete mushroom.

27. The method of claim 4, wherein the specific edible mushroom is a red cracked bolete mushroom.

28. The method of claim 3, wherein the specific amount of time of soaking the specific edible mushroom in the water is 4-6 hours.

29. The method of claim 28, wherein the specific edible mushroom is a smooth volvariblla mushroom.

30. The method of claim 28, wherein the specific edible mushroom is a shaggy mane mushroom.

31. The method of claim 28, wherein the specific edible mushroom is a yellow motel mushroom.

32. The method of claim 28, wherein the specific edible mushroom is a horse mushroom.

33. The method of claim 28, wherein the specific edible mushroom is a spring agaricus mushroom.

34. The method of claim 28, wherein the specific edible mushroom is a gypsy mushroom.

35. The method of claim 28, wherein the specific edible mushroom is a swollen stalked cat mushroom.

36. The method of claim 28, wherein the specific edible mushroom is a red and black russula mushroom.

37. The method of claim 28, wherein the specific edible mushroom is a poplar trich mushroom.

38. The method of claim 28, wherein the specific edible mushroom is a portabella mushroom.

39. The method of claim 28, wherein the specific edible mushroom is a cremini mushroom.

40. The method of claim 28, wherein the specific edible mushroom is a white or button mushroom.

41. The method of claim 28, wherein the specific edible mushroom is an oyster mushroom.

42. The method of claim 28, wherein the specific edible mushroom is a maitake mushroom.

43. The method of claim 28, wherein the specific edible mushroom is a porcini mushroom.

44. The method of claim 28, wherein the specific edible mushroom is an enoki-small white mushroom.

45. The method of claim 28, wherein the specific edible mushroom is a reishi mushroom.

* * * * *